US012410703B1

(12) United States Patent
Panayirci et al.

(10) Patent No.: US 12,410,703 B1
(45) Date of Patent: Sep. 9, 2025

(54) TEMPERATURE MEASUREMENT AT ONE OR MORE CUTTING ELEMENTS OF A DRILL BIT

(71) Applicant: Schlumberger Technology Corporation, Sugar Land, TX (US)

(72) Inventors: Huseyin Murat Panayirci, Cambridge (GB); Andrew David Robinson, Cambridge (GB); Timothy McAlinden, Cambridge (GB); Nicholas Heaton, Cambridge (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/639,374

(22) Filed: Apr. 18, 2024

(51) Int. Cl.
*E21B 47/07* (2012.01)

(52) U.S. Cl.
CPC ..... *E21B 47/07* (2020.05)

(58) Field of Classification Search
CPC ..... E21B 47/07
See application file for complete search history.

(56) References Cited

U.S. PATENT DOCUMENTS

| | | | | |
|---|---|---|---|---|
| 7,604,072 | B2 | 10/2009 | Pastusek et al. | |
| 8,746,367 | B2 * | 6/2014 | DiGiovanni | E21B 47/013 175/428 |
| 8,807,242 | B2 * | 8/2014 | Cheng | E21B 10/62 175/428 |
| 9,297,251 | B2 * | 3/2016 | Poitzsch | E21B 47/013 |
| 9,328,561 | B2 * | 5/2016 | Trinh | E21B 47/013 |
| 9,500,070 | B2 * | 11/2016 | DiGiovanni | E21B 10/50 |
| 9,606,008 | B2 * | 3/2017 | Liversage | G01K 13/00 |
| 11,668,181 | B2 * | 6/2023 | Alarawi | E21B 47/006 166/250.01 |
| 11,867,055 | B2 * | 1/2024 | Zhan | E21B 47/013 |
| 12,188,302 | B2 * | 1/2025 | Ghosh | E21B 47/01 |
| 2015/0322781 | A1 | 11/2015 | Pelletier | |
| 2022/0154536 | A1 * | 5/2022 | Aghdam | E21B 10/46 |
| 2023/0125398 | A1 | 4/2023 | Abdelaal | |
| 2024/0401466 | A1 * | 12/2024 | Hird | E21B 47/07 |

FOREIGN PATENT DOCUMENTS

| | | | |
|---|---|---|---|
| CA | 3012597 | C | 3/2021 |
| EP | 1632644 | B1 | 5/2011 |
| WO | 2023102528 | A1 | 6/2023 |

* cited by examiner

*Primary Examiner* — Kenneth L Thompson

(57) ABSTRACT

Methods and systems are disclosed that use a temperature sensor integral to a drill bit during drilling. The temperature sensor is configured to measure temperature associated with a cutting element of the drill bit over time during drilling. The temperature sensor is used to generate temperature data representing temperature of the cutting element of the drill bit over time during drilling. The temperature data is processed to determine and monitor at least one condition of the wellbore and/or the drill bit during drilling, such as i) detection of faults or openings or cracks or other geological rock features of the wellbore being drilled, ii) estimation of one or more drilling parameters of the drill bit (such as rate of penetration (ROP), iii) detection of lost cutting element(s), iv) detection of bit balling, and v) detection of drilling efficiency.

9 Claims, 14 Drawing Sheets

TEMPERATURE MEASUREMENT AT ONE OR MORE CUTTING ELEMENTS OF A DRILL BIT

FIELD

The present disclosure relates to while drilling systems and methods that detect and monitor conditions of a drill bit and/or a wellbore drilled by a drill bit.

BACKGROUND

Cutting tools, such as downhole drill bits, are used to drill wellbores into the earth to access hydrocarbon reservoirs (e.g., oil and gas reservoirs) and non-hydrocarbon reservoirs (e.g., geothermal reservoirs). The drill bits have relatively long service lives with relatively infrequent failure, but are expensive to design and manufacture.

While drilling a wellbore, the wellbore and/or the drill bit can experience a number of conditions that can impede the drilling operations and possibly necessitate expensive remedial operations. For example, lost circulation of drilling fluid can occur when the drilling fluid, known commonly as "mud", flows into faults or openings or cracks or other geological rock features of the wellbore being drilled. Lost circulation is typically remediated by reducing the density of the drilling fluid, adding lost circulation material (LCM) to the drilling fluid, and/or pumping LCM pills into the wellbore. These operations add both time and cost to the drilling operation. In another example, the rate of penetration (ROP) of the drill bit or other drilling parameter can deviate from the intended or target ROP value. Specifically, there are a large number of parameters that influence ROP, including rock strength of the formation, revolutions per minute (RPM), and weight on bit (WOB) and the flow rate and characteristics of drilling fluid. Some of these parameters are controllable and some cannot be controlled. In yet another example, one or more cutter elements integral to the drill bit can separate from the drill bit during drilling due to excessive vibration and dynamic loading experienced by the drill bit during drilling. This condition is typically referred to as a lost cutter and can be remediated by a fishing operation to retrieve the lost cutter. If the fishing operation fails, sidetrack drilling operations can be performed in order to drill around the portion of the wellbore which includes the lost cutter. In still another example, the drill bit can experience bit balling while drilling. Bit balling is an undesirable adherence and clinging of clay based drilled solids to the metal surfaces of the drill bit. It is usually caused by the hydration and/or dispersion of clay particles. The bit balling is typically remediated by increasing the weight on the bit, adding chemicals to the drilling fluid or perhaps stopping the drilling and pulling the drill bit of the wellbore to clean the bit. While drilling a wellbore, the wellbore and/or the drill bit can experience a number of conditions that can optimize the drilling operations. For example, drilling efficiency represents a condition where an optimal (high) penetration rate is achieved during drilling. Maintaining drilling efficiency can thus reduce the time and costs of the drilling operation. It can be difficult to detect and monitor these different conditions experienced by the wellbore and/or the drill bit during drilling with accuracy and confidence.

SUMMARY

Methods and systems are disclosed that use a temperature sensor integral to a drill bit during drilling. The temperature sensor is configured to measure temperature associated with a cutting element of the drill bit over time during drilling. The temperature sensor is used to generate temperature data representing temperature of the cutting element of the drill bit over time during drilling. The temperature data is processed to determine and monitor at least one condition of the wellbore and/or the drill bit during drilling.

In embodiments, the temperature sensor can include a thermocouple, a resistance temperature detector (RTD), thermistor, semiconductor-based temperature sensor, infrared temperature sensor, thermometer, bimetallic sensor, change-of-state sensor, silicon diode, or other type of temperature sensor.

In embodiments, the temperature sensor can be configured to measure temperature representative of temperature at or near a cutting surface of the cutting element.

In embodiments, the processing of the temperature data can be performed by a downhole system or a surface-located system.

In embodiments, the at least one condition can relate to detection of one or more faults or openings or cracks or other geological rock features of the wellbore being drilled.

In embodiments, the one or more faults or openings or cracks or other geological rock features of the wellbore being drilled can be detected by fluctuations in the temperature data over time.

In embodiments, the at least one condition can relate to estimation of at least one drilling parameter (such as rate of penetration (ROP)) of the drill bit.

In embodiments, the drilling parameter can be estimated by using a computational model of the drilling parameter as a function of measured temperature.

In embodiments, the computational model can be calibrated for a given combination of rock type and cutting element or bit type.

In embodiments, the at least one condition can relate to detection of at least one lost cutting element.

In embodiments, the at least one lost cutting element can be detected by step changes in the temperature data over time.

In embodiments, the at least one condition can relate to detection of bit balling.

In embodiments, the bit balling can be detected by a gradual variation in the temperature data over time.

In embodiments, the at least one condition can relate to detection of drilling efficiency.

In embodiments, the drilling efficiency can be detected by changes in the temperature data over time.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

The subject disclosure is further described in the detailed description which follows, in reference to the noted plurality of drawings by way of non-limiting examples of the subject disclosure, in which like reference numerals represent similar parts throughout the several views of the drawings, and wherein:

FIG. 11A depict plots of temperature data representing temperature of a gauge cutting element of the drill bit over time during the drilling experiment for the first and second wellbores. FIG. 11B depicts plots of temperature data representing temperature of a conical cutting element of the drill bit over time during the drilling experiment for the first and second wellbores.

DETAILED DESCRIPTION

The particulars shown herein are by way of example and for purposes of illustrative discussion of the embodiments of the subject disclosure only and are presented in the cause of providing what is believed to be the most useful and readily understood description of the principles and conceptual aspects of the subject disclosure. In this regard, no attempt is made to show structural details in more detail than is necessary for the fundamental understanding of the subject disclosure, the description taken with the drawings making apparent to those skilled in the art how the several forms of the subject disclosure may be embodied in practice. Furthermore, like reference numbers and designations in the various drawings indicate like elements.

Embodiments of the present disclosure relate to real-time detection and monitoring of condition(s) of a wellbore and/or drill bit during drilling based on temperature measurements made by at least one temperature sensor integral to the drill bit. The temperature sensor may be configured to measure temperature at or near the cutting surface of a cutting element during drilling. The temperature measurements may be associated with time and/or depth of the drill bit. This may help a drilling operator dynamically adjust or control the drilling (for example, by adjusting one or more drilling parameters) based on the condition(s) of the wellbore and/or drill bit as determined from the real-time detection and monitoring.

Figure 1:
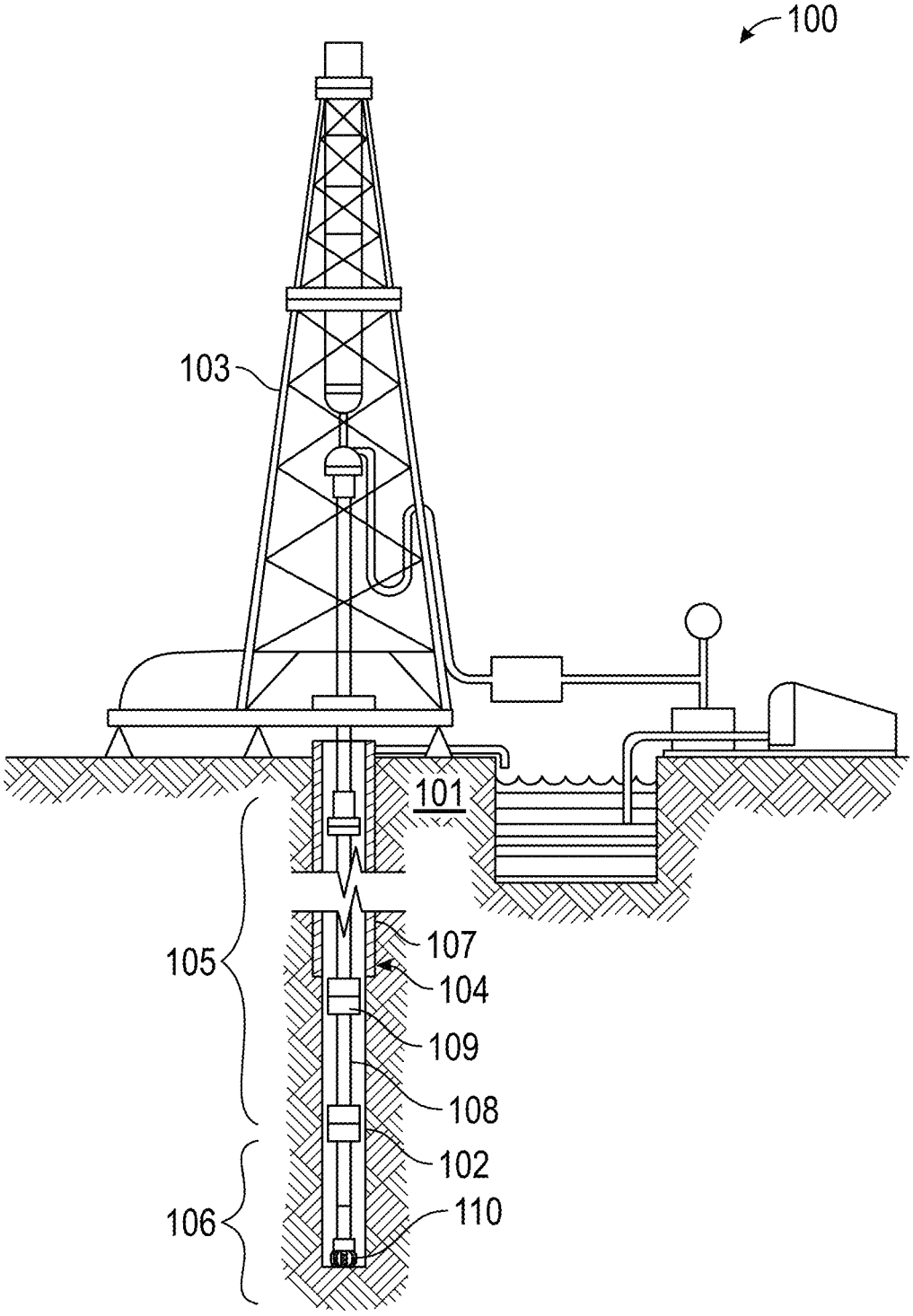
FIG. 1 is a schematic diagram illustrating a drilling system for drilling an earth formation to form a wellbore, according to at least one embodiment of the present disclosure.

FIG. 1 shows a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a drill bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the drill bit 110 for the purposes of cooling the bit 110 and cutting structures thereon, and for lifting cuttings out of the wellbore 102 as it is being drilled.

The BHA 106 may include the drill bit 110 or other components. An example BHA 106 may include additional or other components (e.g., coupled between the drill string 105 and the drill bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing. The BHA 106 may further include a rotary steerable system (RSS). The RSS may include directional drilling tools that change direction of the drill bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the drill bit 110, change the course of the bit 110, and direct or steer the BHA 106 and drill bit 110 on a projected trajectory.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The drill bit 110 in the BHA 106 may be any type of bit suitable for degrading down hole materials. For instance, the drill bit 110 may be a drill bit suitable for drilling the earth formation 101. Example types of drill bits used for drilling earth formations are fixed-cutter or drag drill bits. In other embodiments, the drill bit 110 may be a mill used for removing metal, composite, elastomer, other materials downhole, or combinations thereof. For instance, the drill bit 110 may be used with a whipstock to mill into casing 107 lining the wellbore 102. The drill bit 110 may also be a junk mill used to mill away tools, plugs, cement, other materials within the wellbore 102, or combinations thereof. Swarf or other cuttings formed by use of a mill may be lifted to surface, or may be allowed to fall downhole.

In accordance with at least one embodiment of the present disclosure, temperature data representing temperature measurements made by at least one temperature sensor integral to the drill bit during drilling can be obtained and communicated to a downhole system or surface-located system, and the temperature data can be processed to determine and monitor condition(s) of the wellbore and/or the drill bit during drilling, such as i) detection of faults or openings or cracks or other geological rock features of the wellbore being drilled, ii) estimation of drilling parameters of the drill bit (such as rate of penetration (ROP)), iii) detection of lost cutting element(s), iv) detection of bit balling, and v) detection of drilling efficiency.

In one example, faults or openings or cracks or other geological rock features of the wellbore being drilled can be detected by fluctuations in the temperature data over time.

In another example, one or more drilling parameters (such as rate of penetration (ROP)) can be estimated by using a computational model of the relevant drilling parameter as a function of measured temperature. The computational model can be calibrated for a given combination of rock type and cutting element type. In embodiments, the computational model can include a linear function or equation or a lookup table embodied by computer software. The computational model can be validated by experiments that show a linear change in measured temperature with respect to the drilling parameter for a given combination of rock type and cutting element type. During drilling, the rock type of the formation interval that is being drilled and the cutting element type or bit type for the cutting element associated with the temperature data can be identified and used to select a computational model corresponding to the identified combination of rock type and cutting element/bit type. The selected computation model can be used to determine the relevant drilling parameter (such as rate of penetration (ROP)) based on the temperature data of the cutting element as input.

In yet another example, one or more lost cutting elements can be detected by step changes in the temperature data over time.

In still another example, bit balling can be detected by the gradual variation in the temperature data over time.

In another example, drilling efficiency can be detected by changes in the temperature data over time.

Figure 2A:
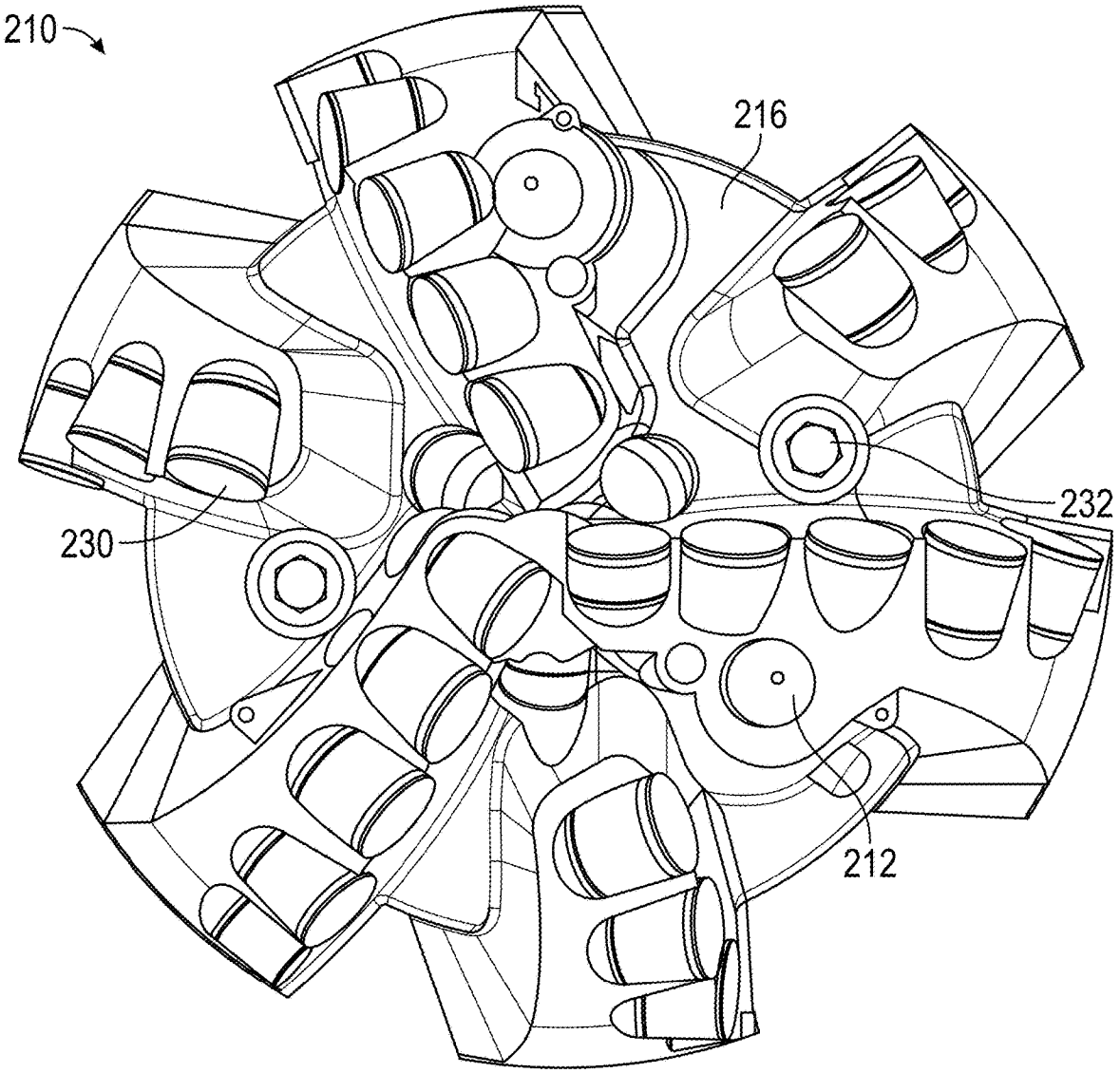
FIG. 2A is a bottom view of a drill bit, according to at least one embodiment of the present disclosure.
Figure 2B:
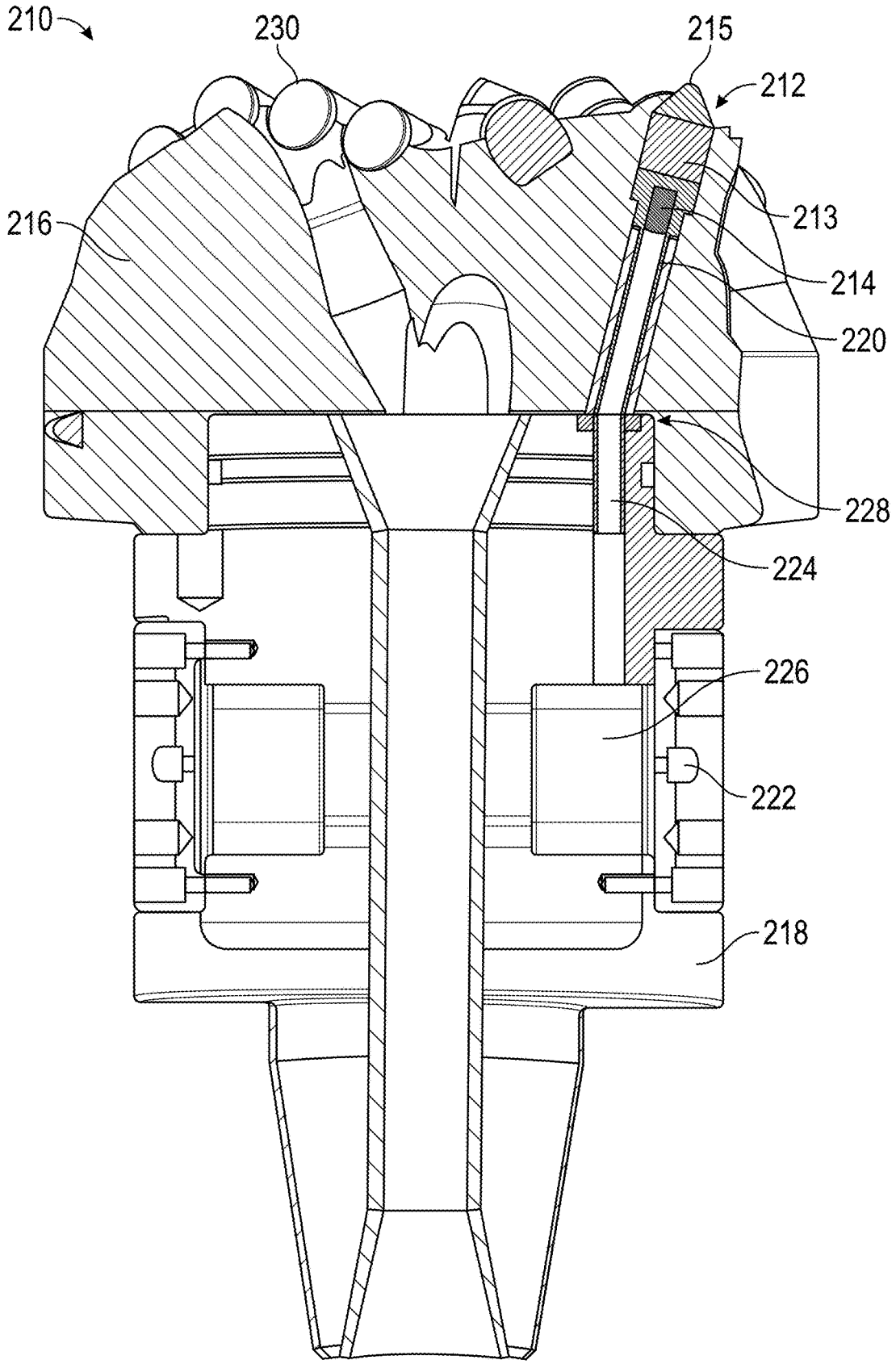
FIG. 2B is a partial cross-sectional view of the drill bit of FIG. 2A.

FIGS. 2A and 2B illustrate an example drill bit 210 according to at least one embodiment of the present disclosure. The drill bit 210 may include conical or other non-planar cutting elements 212 as well as planar or gauge cutting elements 230 (e.g., PDC shear cutters). The drill bit 210 includes a bit head 216 and a pin 218. In the embodiment shown, the bit head 216 may be secured to the pin 218 with a bolted connection, such as with one or more mechanical fasteners 232.

FIG. 2B is a cross-sectional view of the bit 210. Cutting element 212 is instrumented with a temperature sensor 214 integral to the cutting element 212. The cutting element 212 may have conical or ridged cutting surface as shown. Alternatively, the cutting element 212 can have a convex cutting surface, a concave cutting surface, a planar cutting surface, any other shaped cutting surface, and combinations thereof. The temperature sensor 214 may be configured to measure a temperature representative of the temperature at or near the cutting surface of the cutting element 212. In the embodiment shown, the temperature sensor 214 is inserted into a body 213 of the cutting element 212. In some embodiments, the body 213 may define a bore that extends into the body 213. The bore may be located in a substrate of the cutting element 212, such as a tungsten carbide substrate or other substrate. In some embodiments, the bore may extend into the insert of the cutting element 212. For example, the bore may extend into a polycrystalline diamond (PCD) insert connected to the substrate. In embodiments, the bore can be formed by creating a small hole in the back of cutting element 212 and drilling through the hole into the superhard table of the cutting element 212 (e.g., into a polycrystalline diamond table). The temperature sensor 214 can then be inserted in this hole with the hole then filled with thermally conductive potting or paste such that the temperature sensor 214 is in good thermal contact with the diamond or other superhard table of the cutting element 212.

The temperature sensor 214 may be any type of temperature sensor. For example, the temperature sensor 214 may include a thermocouple, a resistance temperature detector (RTD), thermistor, semiconductor-based temperature sensor, infrared temperature sensor, thermometer, bimetallic sensors, change-of-state sensors, silicon diodes, any other types of temperature sensor, and combinations thereof.

The temperature sensor 214 may be inserted into the bore. Inserting the temperature sensor 214 into the bore may allow the temperature sensor 214 to measure a temperature representative of the temperature at or near the cutting surface 215 of the cutting element 212. Note that frictional and contact forces of the cutting surface 215 with the rock of the wellbore during drilling may increase the temperature of the cutting surface 215.

In other embodiments, the temperature sensor 214 may be disposed at another location relative to the cutting element 212. For example, the temperature sensor 214 may be in contact with the cutting element 212, or the temperature sensor 214 may be located adjacent to the cutting element 212, or the temperature sensor 214 may be located close to the outer surface of the bit head 216 parallel to the cutting element 212.

The drill bit 210 includes a wiring conduit 220 that extends through at least a portion of the bit head 216 to the pin 218. The wiring conduit 220 may allow wiring from the temperature sensor 214 to extend through the drill bit 210 to an electronics module 222 in the pin 218. In some embodiments, the wiring conduit 220 may include a pipe or a sleeve that is inserted into the bit head 216 during manufacturing. In some embodiments, the bit head 216 may be additively manufactured, and the wiring conduit 220 and/or a void for the wiring conduit 220 may be formed during the additive manufacturing process. In some embodiments, the wiring conduit 220 may extend through an integrally formed portion of the bit head 216. While embodiments of the present disclosure are directed to a bit pin 218, it should be understood that the bit head 216 may be connected to any other connector, including a bit box.

During assembly or manufacture of the bit head 216 and the pin 218, the wiring conduit 220 may align with a pin conduit 224. The wiring from the temperature sensor 214 may pass from the wiring conduit 220 in the bit head 216 to the pin conduit 224. The pin conduit 224 may allow the wiring to pass to the electronics module 222. In this manner, the temperature sensor 214 may be connected to the electronics module 222 in the pin 218. In some embodiments, the wiring conduit 220 may be aligned with the pin conduit 224 when the bit head 216 is secured to the pin 218.

In embodiments, the bit head 216 can be coupled to the pin 218 in any manner. For example, the bit head 216 may be connected to the pin 218 with a bolted connection. In some examples, the bit head 216 may be connected to the pin 218 with a threaded connection. In some examples, when the bit head 216 is coupled to the pin 218, the wiring conduit 220 and the pin conduit 224 may be aligned. In some embodiments, a bolted connection between the bit head 216 and the pin 218 may facilitate the alignment of the wiring conduit 220 and the pin conduit 224.

As discussed herein, the drill bit 210 may include an electronics module 222 with one or more wires or cables connecting the temperature sensor 214 to the electronics module 222. The wire(s) or cable(s) carry the electric signals that represent the temperature measurements performed by the temperature sensor 214. In some embodiments, the electronics module 222 can collect and monitor data representing the temperature measurements made by the temperature sensor 214. In some embodiments, the electronics module 222 may record or store data representing the temperature measurements in electronic memory.

In the embodiment shown, the pin 218 contains one or more instrumentation pockets 226 or other features that can house or connect to electronics module 222. The wiring conduit 220 may extend from the cutting element 212 to the instrumentation pocket 226. In some embodiments, the electronics module 222 may be located in the instrumentation pocket 226. In some embodiments, the instrumentation pocket 226 may include other sensors. For example, the one or more instrumentation pockets 226 may include a force sensor, a torque sensor, an accelerometer, a gyroscopic sensor, a pressure sensor, a temperature sensor to measure temperature of the drilling fluid, any other sensors, and combinations thereof. In some embodiments, the information from the one or more sensors in the instrumentation pocket 226 may be used to detect and monitor condition(s) of the wellbore and/or the drill bit as described herein.

In embodiments, the drill bit 210 can include a fluid and/or pressure seal between the electronic components and the drilling fluid. For example, the bit head 216 may include a head seal 228 between the bit head 216 and the pin 218 at the interface between the wiring conduit 220 and the pin conduit 224. The head seal 228 may include a sealing member, such as an O-ring or other sealing member. The head seal 228 may further include a resilient element. When the bit head 216 is secured to the pin 218, the compressive force of the connection may compress the resilient element against the sealing member. The compressed sealing member may result in a seal between the bit head 216 and the pin 218. This may help to reduce and/or prevent the ingress of drilling fluid and/or other contaminants into the wiring conduit 220 and the pin conduit 224. In some embodiments, the resilient element may be a frustoconical resilient elements, such as a Belleville washer. In some embodiments, the resilient element may include a wave spring or other resilient element. In some embodiments, the instrumentation pocket 226 may include a seal between the instrumentation pocket 226 and the borehole annulus to reduce or prevent the ingress of drilling fluid and/or other contaminants into the instrumentation pocket 226.

In the embodiment shown, the bit drill 210 includes multiple cutting elements, including cutting element 212 and cutting element 230. One or more of the cutting elements may be PDC cutters or have other compositions. The drill bit 210 can be equipped with additional temperature sensor(s) that are similar to temperature sensor 214 as described herein. Such additional temperature sensor(s) can be configured to measure temperature at the cutting surface of other cutting elements, such as cutting element 230. The bit head 216 and the pin 218 can be configured with additional conduits that carry one or more wires or cables connecting the additional temperature sensor(s) to the electronics module 222.

In embodiments, the electronics module 222 can communicate with a downhole device. For example, the electronics module 222 can communicate with a MWD module, such as through a wired and/or a wireless connection. The MWD module may receive data representing the temperature measurements performed by the temperature sensor(s) integral to the drill bit 210.

In embodiments, the MWD module or other downhole system (which can include module 222) can be configured to collect and process data representing the temperature measurements in real-time during drilling to determine and monitor conditions of the wellbore being drilling by the drill bit 210 during the drilling, such as i) detection of faults openings or cracks, ii) estimation of rate of penetration, iii) detection of lost cutting element(s), iv) detection of bit balling, and v) detection of drilling efficiency. The MWD module or other downhole system can then communicate data representing such condition(s) to a surface-located system for output to a drilling operator. For example, the MWD module may communicate the data representing such condition(s) using any downhole communication system, including mud pulse telemetry, electromagnetic communication, wired drill pipe, drill pipe telemetry, any other downhole communication system, and combinations thereof. The surface-located system can output or otherwise convey the condition(s) of the wellbore and/or drill bit 210 as determined from the monitoring via visual and/or audible alerts presented to the drilling operator. In embodiments, the drilling operator can dynamically adjust or control the drilling (for example, by adjusting one or more drilling parameters) based on the condition(s) of the wellbore and/or the drill bit 210 as represented by the data representing such condition(s).

In other embodiments, the MWD module or other downhole system (which can include module 222) can be configured to collect data representing the temperature measurements and communicate such data to a surface-located system. For example, the MWD module may communicate the data representing the temperature measurements using any downhole communication system, including mud pulse telemetry, electromagnetic communication, wired drill pipe, drill pipe telemetry, any other downhole communication system, and combinations thereof. The surface-located system can be configured to process the data representing the temperature measurements to determine and monitor condition(s) of the wellbore being drilled by the drill bit 210 during drilling, such as i) detection of faults openings or cracks, ii) estimation of rate of penetration, iii) detection of lost cutting element(s), iv) detection of bit balling, and v) detection of drilling efficiency. The surface-located system can output or otherwise convey the condition(s) of the wellbore and/or the drill bit 210 as determined from the monitoring via visual and/or audible alerts presented to the drilling operator. In embodiments, the drilling operator can dynamically adjust or control the drilling (for example, by adjusting one or more drilling parameters) based on the condition(s) of the wellbore and/or the drill bit 210 as determined from the monitoring.

Figure 3:
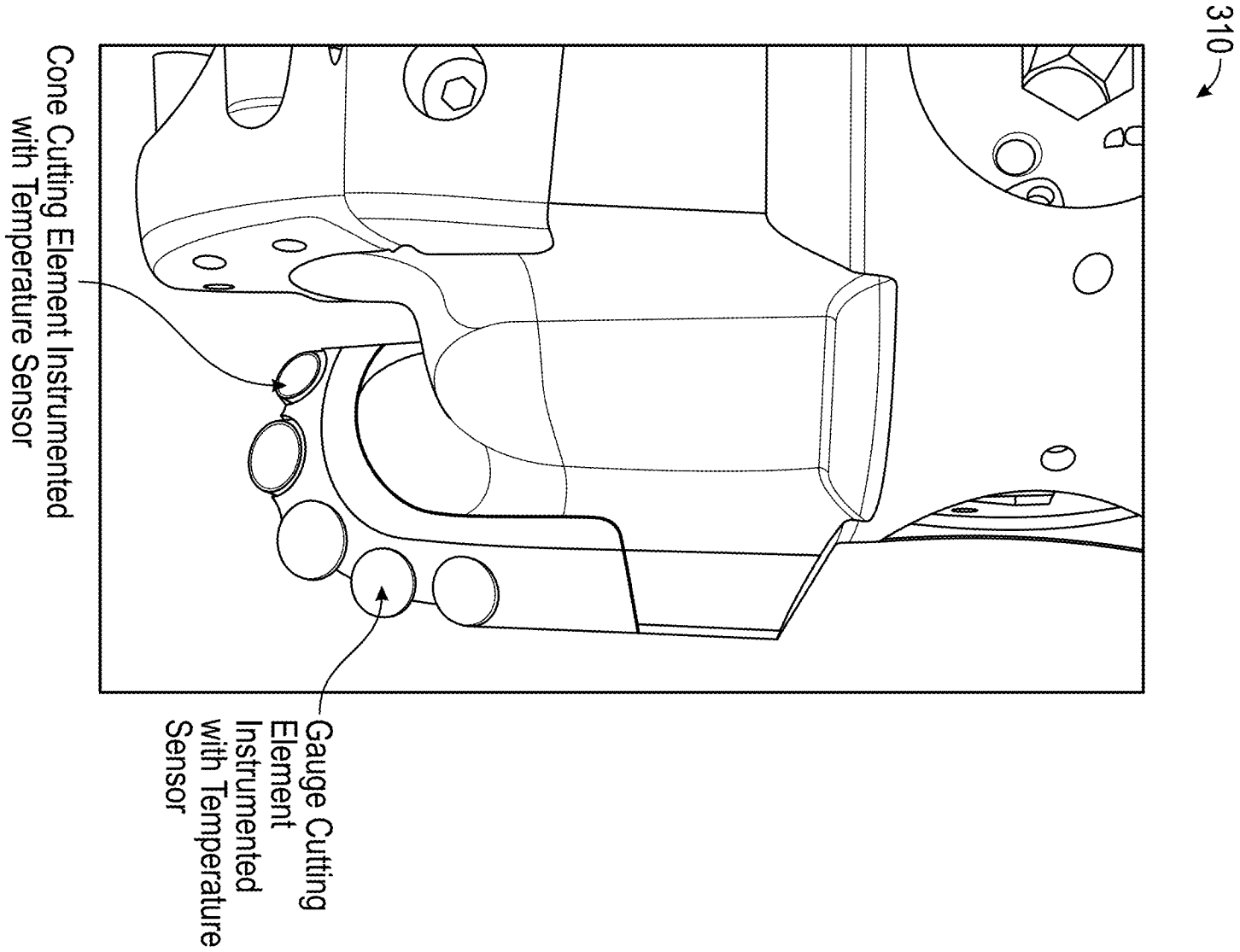
FIG. 3 is an image of part of a drill bit, according to at least one embodiment of the present disclosure.

FIG. 3 is an image of part of a fixed-cutter drill bit 310 that has a blade with a gauge cutting element instrumented with a temperature sensor as well as a cone cutting element instrumented with a temperature sensor in a manner similar to that described above with respect to FIGS. 2A and 2B.

Figure 4:
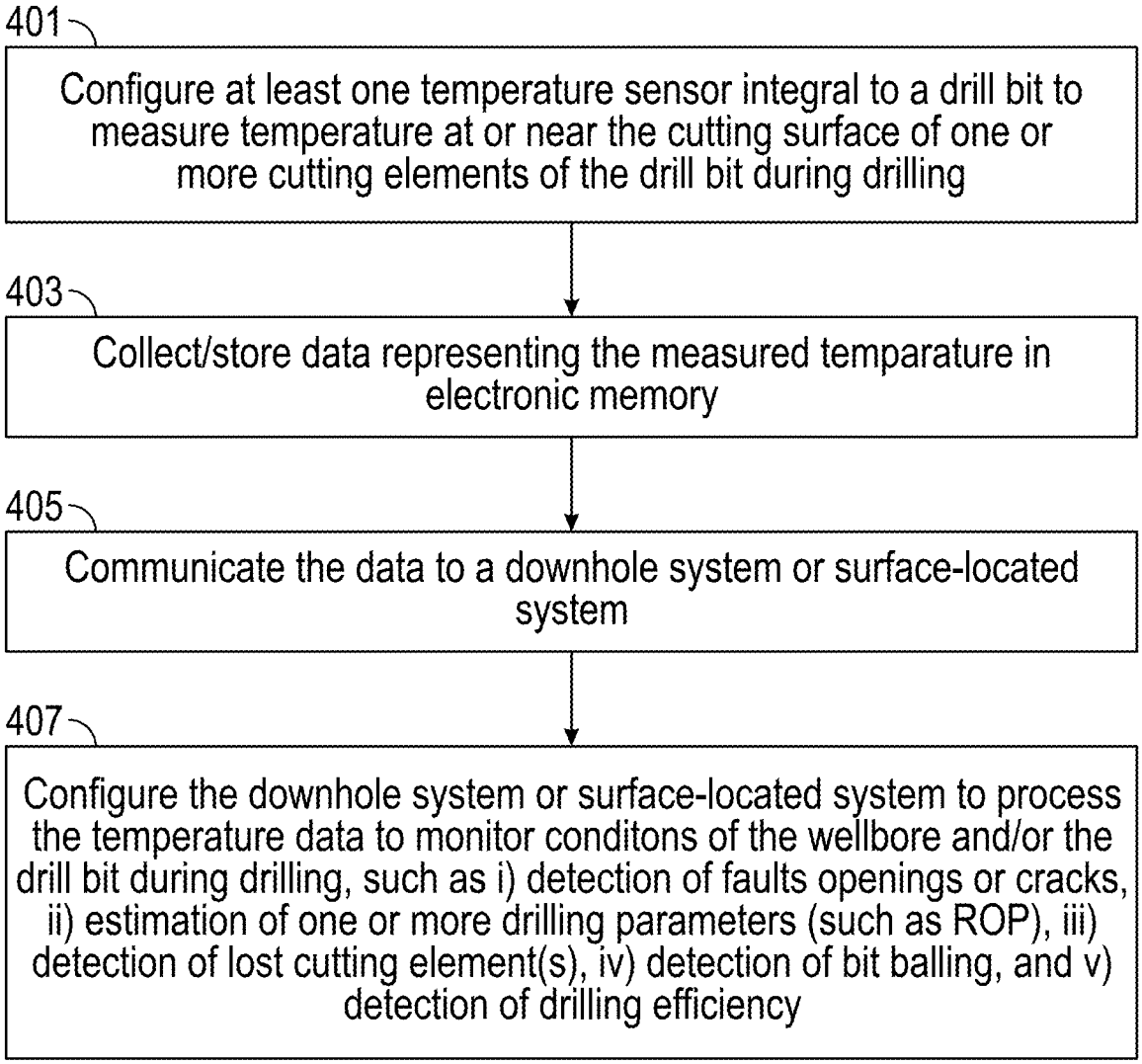
FIG. 4 is a flowchart of a method for real-time detection and monitoring of condition(s) of a wellbore and/or drill bit during drilling based on temperature measurements made by at least one temperature sensor integral to the drill bit, according to at least one embodiment of the present disclosure.

FIG. 4 is a flowchart that implements a method for real-time detection and monitoring of condition(s) of a wellbore and/or drill bit during drilling based on temperature measurements made by at least one temperature sensor integral to the drill bit.

The operations begin in block 401 by configuring at least one temperature sensor integral to a drill bit to measure temperature at or near the cutting surface of one or more cutting elements of the drill bit during drilling.

In block 403, data representing the measured temperature of 401 is collected/stored in electronic memory.

In block 405, the temperature data of 403 is communicated to a downhole system or surface-located system.

In block 407, the downhole system or surface-located system of 405 is configured to process the temperature data to monitor conditions of the wellbore and/or the drill bit during drilling, such as i) detection of faults openings or cracks, ii) estimation of one or more drilling parameters (such as ROP), iii) detection of lost cutting element(s), iv) detection of bit balling, and v) detection of drilling efficiency.

For example, as part of block 407, faults or openings or cracks or other geological rock features of the wellbore being drilled can be detected by fluctuations in the temperature data representing temperature of one or more cutting elements over time.

In another example, as part of block 407, one or more drilling parameters (such as rate of penetration (ROP)) can be estimated by using a computational model of the drilling parameter as a function of measured temperature. The computational model can be calibrated for a given combination of rock type and cutting element type. In embodiments, the rock type of the formation interval that is being drilled and the cutting element type for the cutting element associated, the temperature data can be identified and used to select a computational model corresponding to the identified combination of rock type and cutting element type. The selected computation model can be used to determine the relevant drilling parameter (such as rate of penetration (ROP)) based on the temperature data representing temperature of the cutting element as input.

In yet another example, as part of block 407, one or more lost cutting elements can be detected by step changes in the temperature data representing temperature of one or more cutting elements over time. The lost cutting element(s) can be separated from the drill bit during drilling due to excessive vibration and dynamic loading experienced by the drill bit during drilling.

In still another example, as part of block 407, bit balling can be detected by a gradual increase or variation in the temperature data representing temperature of one or more cutting elements over time. Bit balling is an undesirable adherence and clinging of clay based drilled solids to the metal surfaces of the drill bit. It is usually caused by the hydration and/or dispersion of clay particles.

In another example, as part of block 407, drilling efficiency can be detected by changes in the temperature data representing temperature of one or more cutting elements over time. Drilling efficiency represents a condition where an optimal (high) penetration rate is achieved during drilling.

Figure 5A:
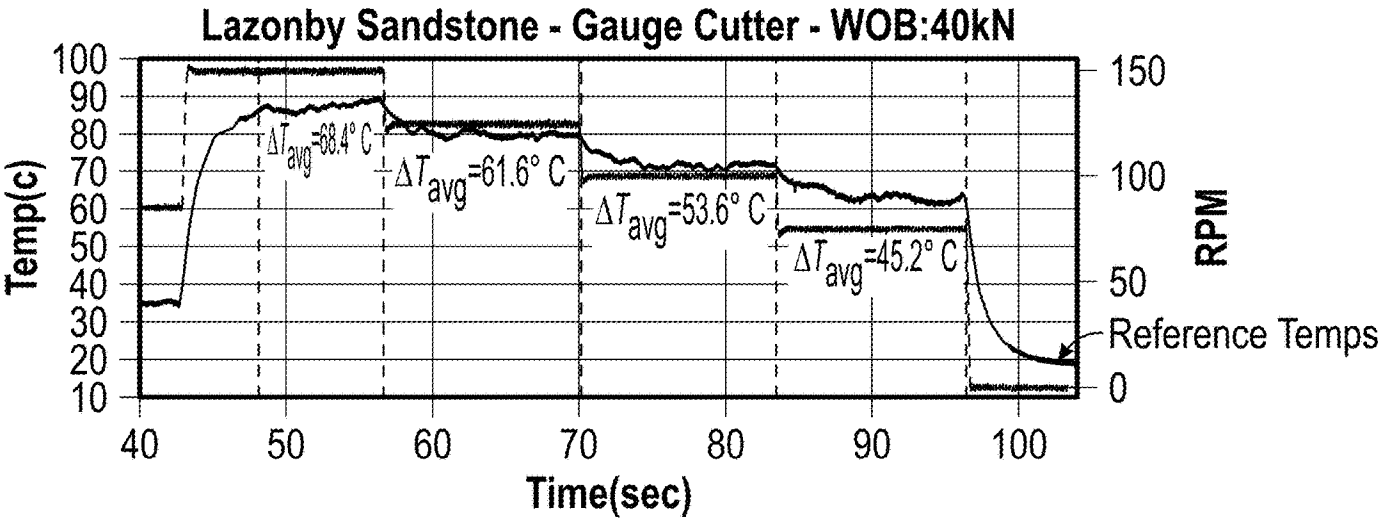
FIG. 5A depicts plots of temperature data representing temperature of the gauge cutting element of the drill bit of FIG. 3 and RPM of the drill bit over time during a drilling experiment that follows the workflow of FIG. 4.
Figure 5B:
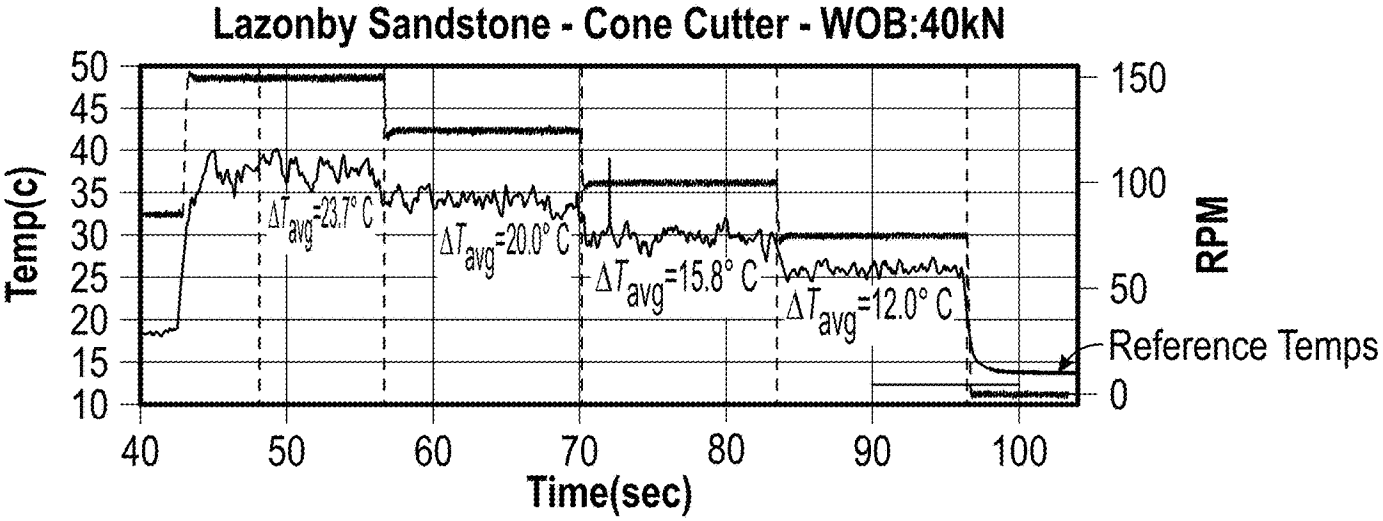
FIG. 5B depicts plots of temperature data representing temperature of the conical cutting element of the drill bit of FIG. 3 and RPM of the drill bit over time during the same drilling experiment of FIG. 5A.

FIG. 5A depicts plots of temperature data representing temperature of the gauge cutting element of the drill bit 301 of FIG. 3 and RPM of the drill bit 301 over time during a drilling experiment that follows the workflow of FIG. 4. FIG. 5B depicts plots of temperature data representing temperature of the conical cutting element of the drill bit 301 of FIG. 3 and RPM of the drill bit 301 over time during the same drilling experiment of FIG. 5A. In the drilling experiment of FIGS. 5A and 5B, the RPM of the drill bit 301 can be determined by one or more downhole sensors, such as a gyroscope, which is part of the BHA of the drilling system as is well known.

Figure 6A:
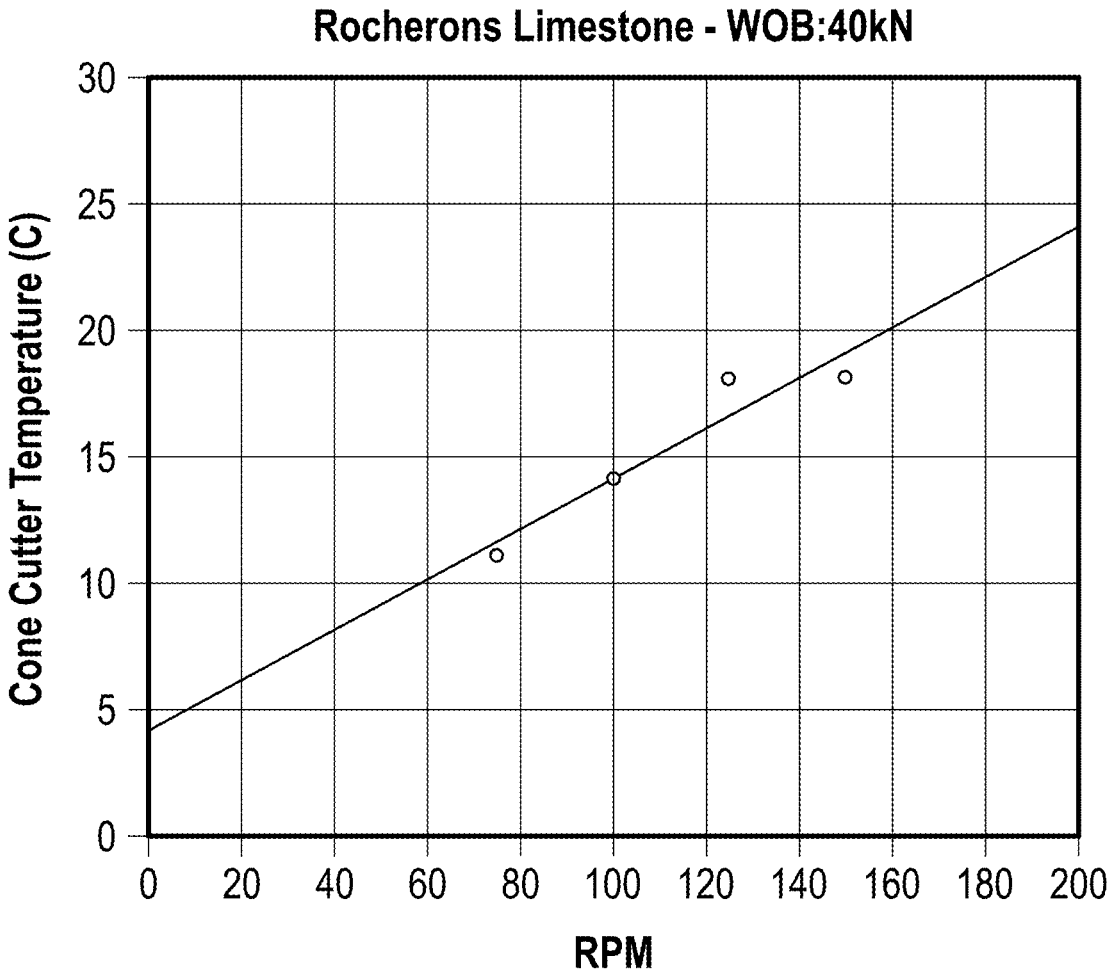
FIG. 6A is a plot of temperature data representing temperature of the conical cutting element of the drill bit of FIG. 3 as a function of RPM of the drill bit during the drilling experiment of FIGS. 5A and 5B.
Figure 6B:
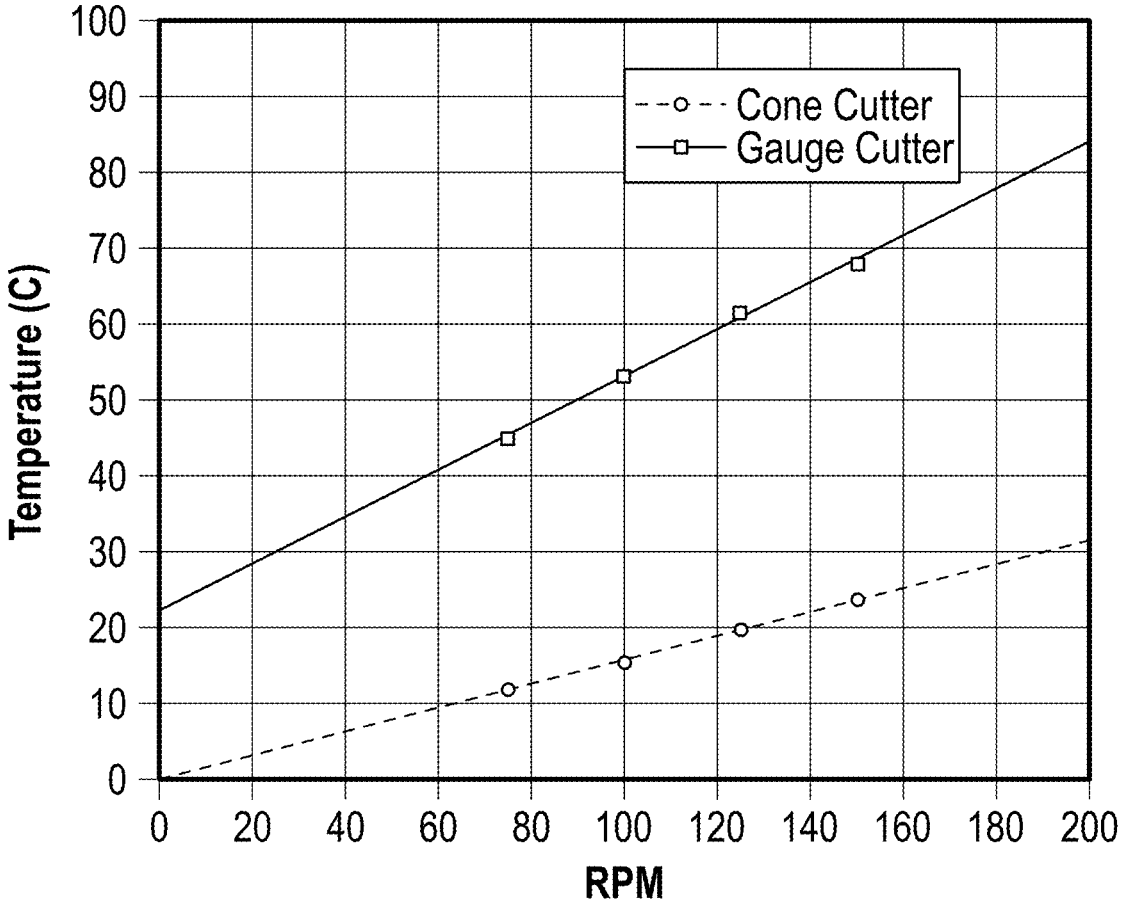
FIG. 6B depict plots of temperature data representing temperature of the gauge cutting element and conical cutting element, respectively, of the drill bit of FIG. 3 as a function of RPM of the drill bit during the drilling experiment of FIGS. 5A and 5B.

FIG. 6A is a plot of temperature data representing temperature of the conical cutting element of the drill bit 301 of FIG. 3 as a function of RPM of the drill bit 301 during the drilling experiment of FIGS. 5A and 5B. FIG. 6B depict plots of temperature data representing temperature of the gauge cutting element and conical cutting element, respectively, of the drill bit 301 of FIG. 3 as a function of RPM of the drill bit 301 during the drilling experiment of FIGS. 5A and 5B. The top plot represents the temperature measurements for the gauge cutting element as a function of RPM of the drill bit 301. The bottom plot represents the temperature measurements for the conical cutting element as a function of RPM of the drill bit 301. Note that the temperatures of the cutting elements both depend linearly on RPM. However the slope of the curve and the offset at y axis are most likely dependent on rock type, and cutter type/size. Thus, a linear function can be fitted to the experimental temperature data of the top plot to derive a computational model that relates the temperature measurement for the gauge type cutting element to rate of penetration (ROP) of the drill bit during drilling. Similarly, a linear function can be fitted to the experimental temperature data of the bottom plot to derive a computational model that relates the temperature measurement for the conical type cutting element to rate of penetration (ROP) of the drill bit during drilling. The computation model(s) can be specific to a given rock type. The drilling experiments can be repeated for different rock types to derive computational models that relate cutting element temperature to drill bit ROP for different combinations of cutting element type and rock type. During drilling, the rock type of the formation interval that is being drilled and the cutting element type (such as conical type or gauge type for a given bit) for the cutting element associated with the temperature data can be identified and used to select the computational model corresponding to the identified combination of rock type and cutting element type. The selected computation model can be used to determine the rate of penetration (ROP) of the drill bit based on the temperature data of the cutting element as input.

Figure 7:
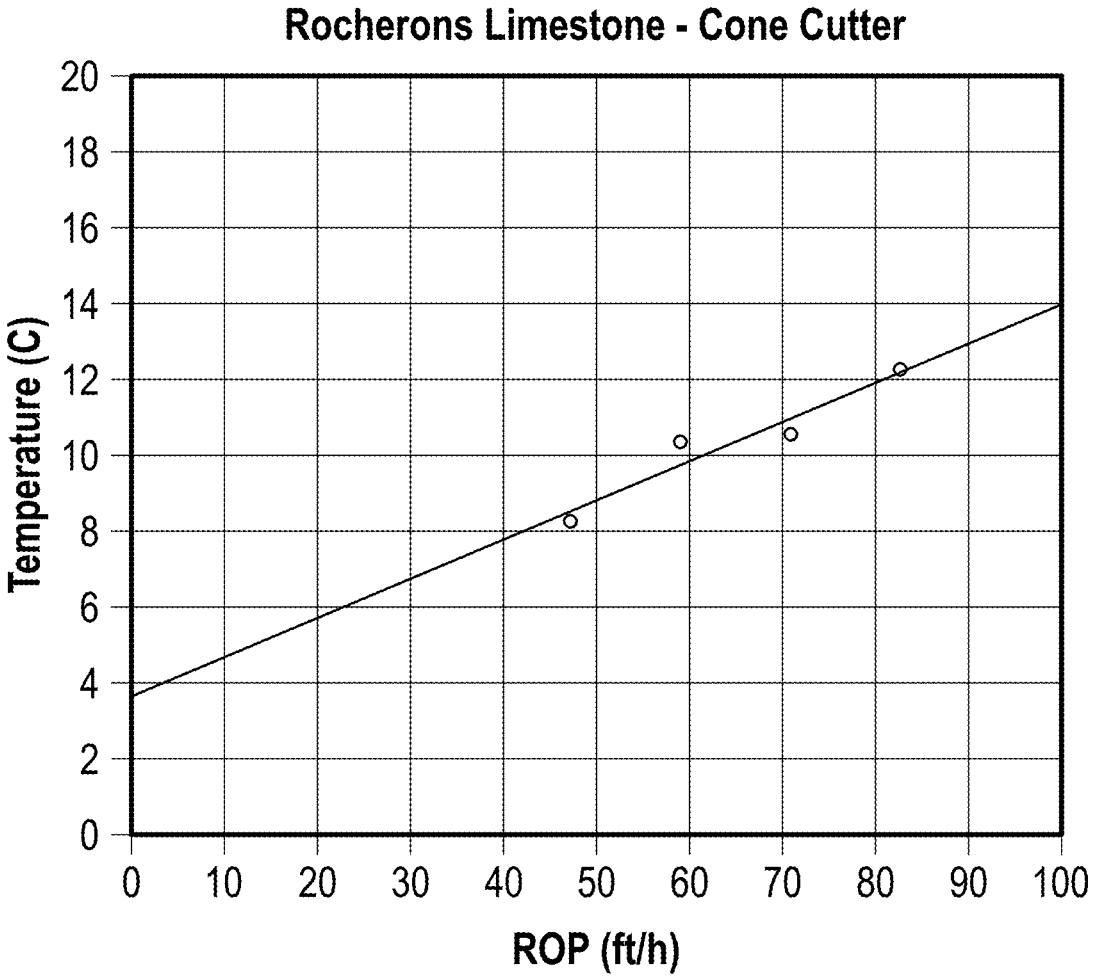
FIG. 7 is a plot of temperature data representing temperature of the conical cutting element of the drill bit of FIG. 3 as a function of ROP of the drill bit during the drilling experiment of FIGS. 5A and 5B.

FIG. 7 is a plot of temperature data representing temperature of the conical cutting element of the drill bit 301 of FIG. 3 as a function of ROP of the drill bit 301 during the drilling experiment of FIGS. 5A and 5B. Note that the measured temperature of the conical cutting element depends linearly on ROP. Thus, a linear function can be fitted to the experimental temperature data to derive a computational model that relates the temperature measurement for the conical type cutting element to ROP of the drill bit during drilling. Similarly, a linear function can be fitted to the experimental temperature data to derive a computational model that relates the temperature measurement for the gauge type cutting element to ROP of the drill bit during drilling. The computation model(s) can be specific to a given rock type. The drilling experiments can be repeated for different rock types and different bits or bit types to derive computational models that relate cutting element temperature to drill bit ROP for different combinations of cutting element type/bit type and rock type.

In embodiments, the computational model for a particular combination of bit type (cutter type/size) and rock type can be derived from experiments performed at various ROP values that measure corresponding cutter temperatures. Once a plot similar to FIG. 7 is obtained, the slope and offset of the curve can be calculated. This curve can be then used to predict rate of penetration (ROP) of the drill bit while drilling in a real drilling operation, given that the same or similar drill bit (with the same or similar cutter as used in the experiments is instrumented with a temperature sensor) is drilling the same or similar rock type. As temperature data is obtained during drilling, corresponding ROP can be predicted from the curve.

Figure 8:
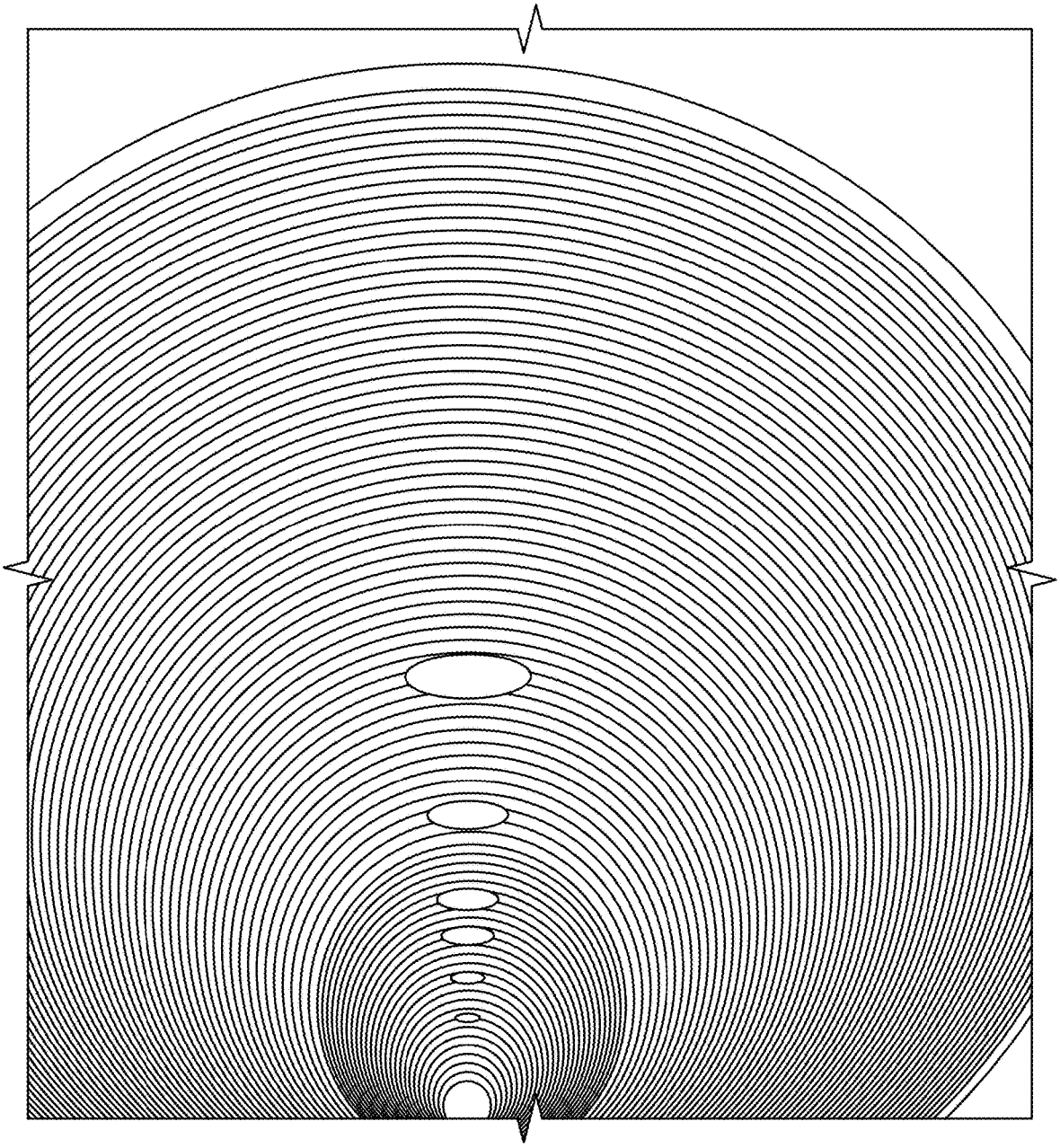
FIG. 8 is an image of a drilling experiment performed on a Lazonby rock with four (4) small lateral holes disposed along the depth dimension of the rock. This drilling experiment aims to demonstrate that these holes can be detected with temperature measurements for one or more cutting elements of a drill bit as described herein.

FIG. 8 illustrates a drilling experiment performed on a Lazonby rock with four (4) small lateral holes disposed along the depth dimension of the rock. This drilling experiment aims to demonstrate that these holes can be detected with temperature measurements for one or more cutting elements of a drill bit as described herein.

Figure 9:
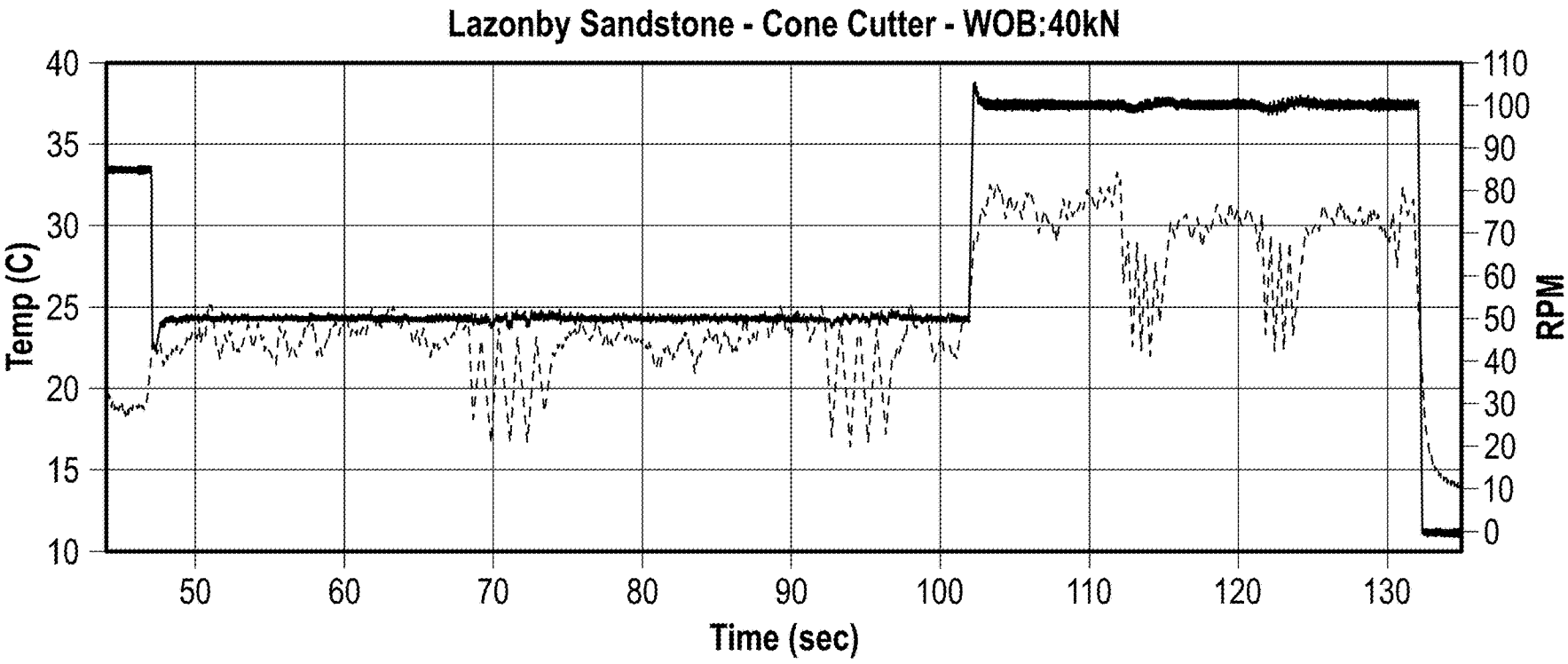
FIG. 9 is a plot of temperature data representing temperature of the conical cutting element of the drill bit of FIG. 3 and RPM of the drill bit over time during the drilling experiment of FIG. 8.

FIG. 9 is a plot of temperature data representing temperature of the conical cutting element of the drill bit 301 of FIG. 3 and RPM of the drill bit 301 over time during this drilling experiment. This plot shows that the four (4) lateral holes can be detected by processing the temperature data to identify fluctuations in the temperature data over time that are representative of the geological rock features. Similar processing can be used to identify faults or openings or cracks or other geological rock features of the wellbore being drilled.

Figure 10:
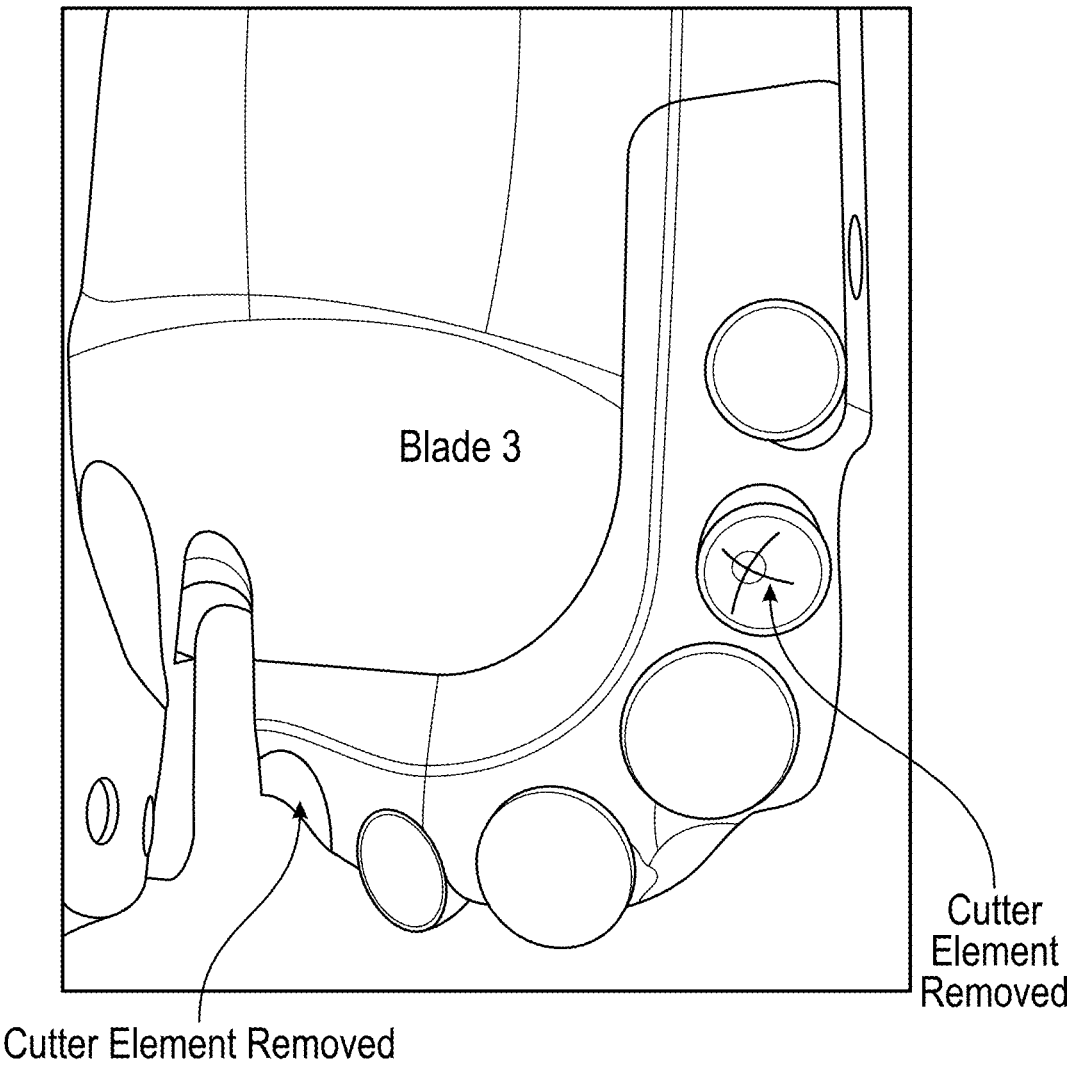
FIG. 10 is an image of a drilling experiment that is designed to demonstrate that one or more lost cutting elements can be detected with temperature measurements for one or more cutting elements of a drill bit.
Figure 11A:
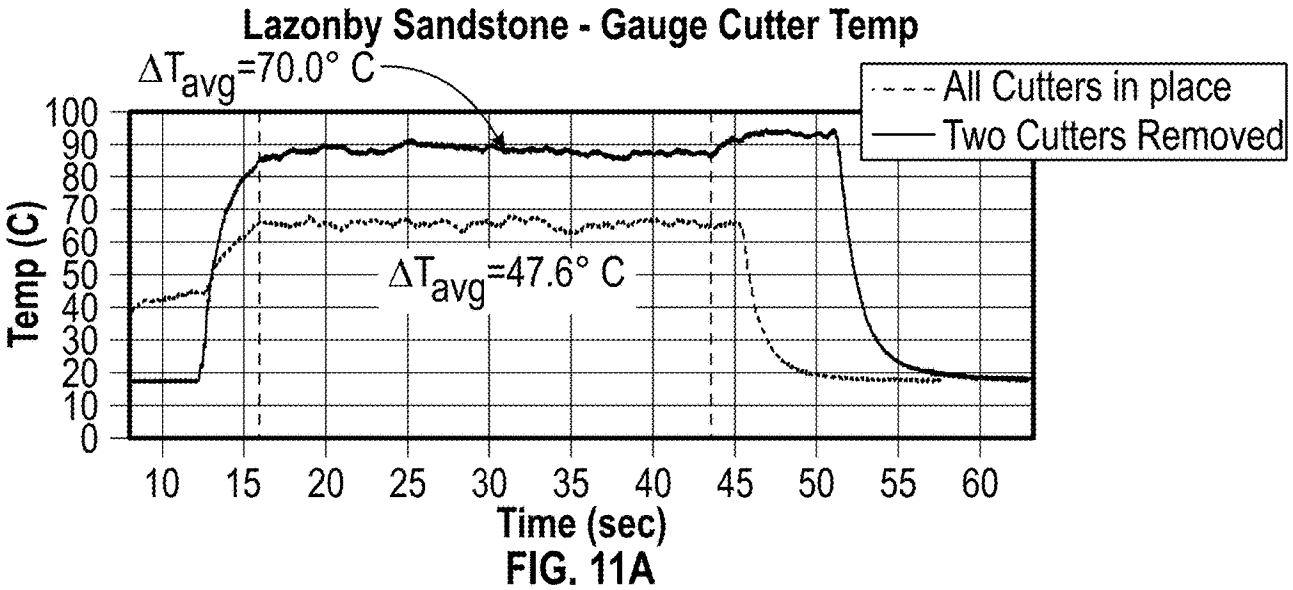
FIGS. 11A and 11B depict plots of temperature data obtained from a drilling experiment that involved drilling first and second wellbores into the same or similar Lazonby rock with common drilling parameters (e.g., RPM, ROP, WOB). The first wellbore is drilled in the rock with all cutting elements of the drill bit in place. The second wellbore is drilled in two parts. In this first part, the first half of the wellbore is drilled with all cutting elements of the drill bit in place. In the second part, two cutting elements are removed from the drill bit as shown in FIG. 10 and the second half of the wellbore is drilled.
Figure 11B:
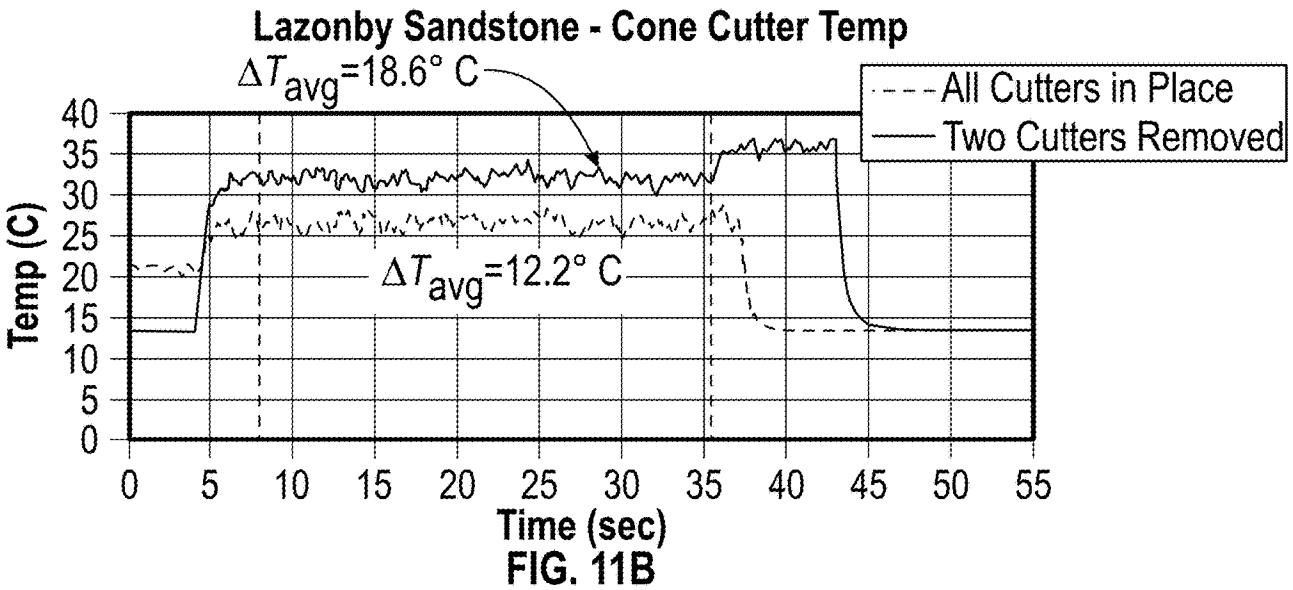

Another drilling experiment was performed that involved drilling first and second wellbores into the same or similar Lazonby rock with common drilling parameters (e.g., RPM, ROP, WOB). The first wellbore is drilled in the rock with all cutting elements of the drill bit in place. The second wellbore is drilling in two parts. In this first part, the first half of the wellbore is drilled with all cutting elements of the drill bit in place. In the second part, two cutting elements are removed from the drill bit as shown in FIG. 10 and the second half of the wellbore is drilled. FIG. 11A depict plots of temperature data representing temperature of a gauge cutting element of the drill bit over time during the drilling experiment for the first and second wellbores. The top plot shows the temperature measurements for the gauge cutting element of the drill bit over time while drilling the first wellbore. The bottom plot shows the temperature measurements for the same gauge cutting element of the drill bit over time while drilling the second wellbore. FIG. 11B depicts plots of temperature data representing temperature of a conical cutting element of the drill bit over time during the drilling experiment for the first and second wellbores. The top plot shows the temperature measurements for a conical cutting element of the drill bit over time while drilling the first wellbore. The bottom plot shows the temperature measurements for the same conical cutting element of the drill bit over time while drilling the second wellbore. The plots of FIGS. 11A and 11B show that lost cutting element(s) can be detected by processing the temperature data to identify increased temperature in the temperature data for the respective cutting element(s) which is representative of the presence of one or more lost cutting element(s).

Figure 12:
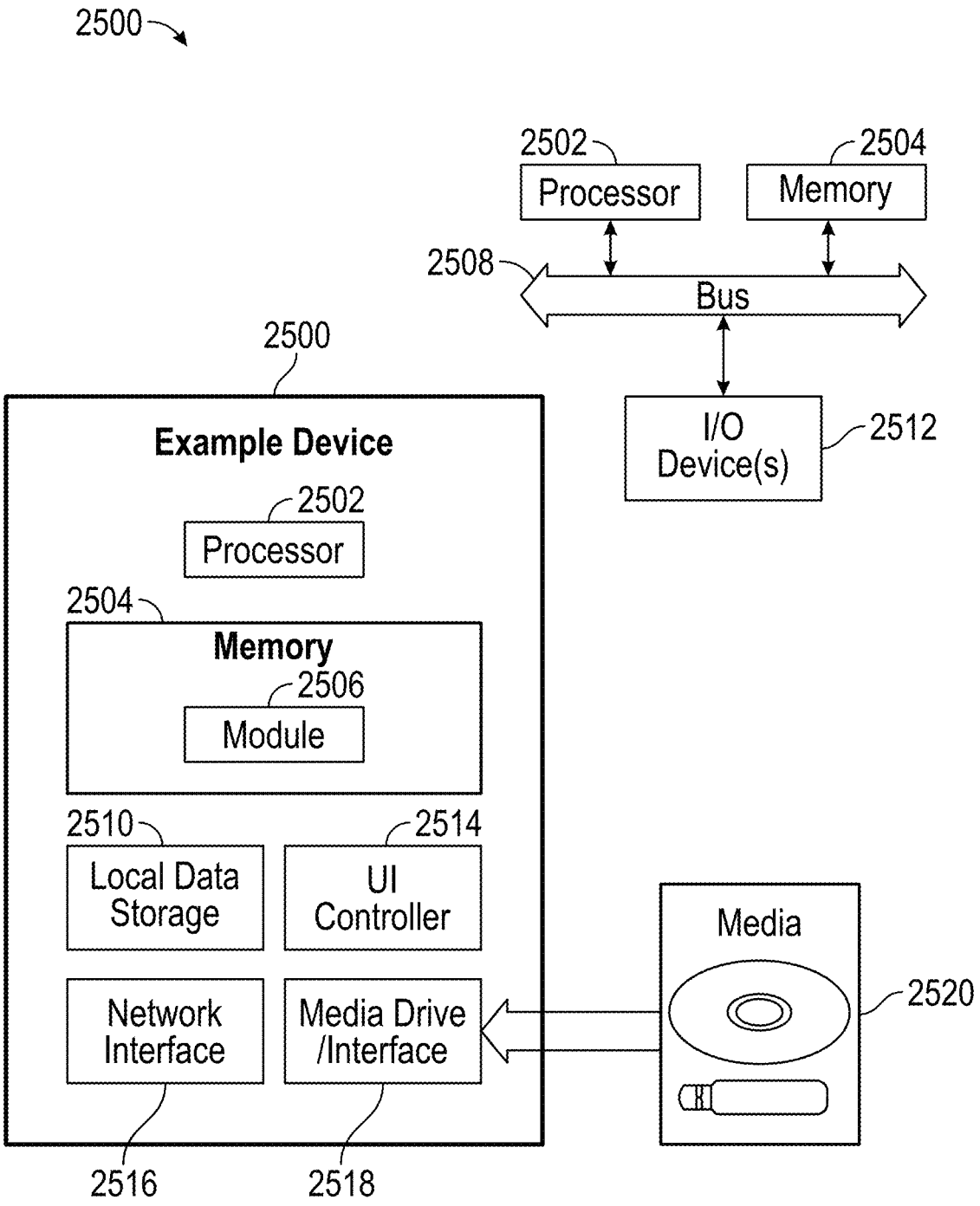
FIG. 12 is a schematic block diagram of a computer processing system.

FIG. 12 illustrates an example device 2500, with a processor 2502 and memory 2504 that can be configured to implement part(s) of methods and workflows as discussed in the present disclosure. Memory 2504 can also host one or more databases and can include one or more forms of volatile data storage media such as random-access memory (RAM), and/or one or more forms of nonvolatile storage media (such as read-only memory (ROM), flash memory, and so forth).

Device 2500 is one example of a computing device or programmable device and is not intended to suggest any limitation as to scope of use or functionality of device 2500 and/or its possible architectures. For example, device 2500 can comprise one or more computing devices, programmable logic controllers (PLCs), etc.

Further, device 2500 should not be interpreted as having any dependency relating to one or a combination of components illustrated in device 2500. For example, device 2500 may include one or more of: computers, such as a laptop computer, a desktop computer, a mainframe computer, etc., or any combination or accumulation thereof.

Device 2500 can also include a bus 2508 configured to allow various components and devices, such as processors 2502, memory 2504, and local data storage 2510, among other components, to communicate with each other.

Bus 2508 can include one or more of any of several types of bus structures, including a memory bus or memory controller, a peripheral bus, an accelerated graphics port, and a processor or local bus using any of a variety of bus architectures. Bus 2508 can also include wired and/or wireless buses.

Local data storage 2510 can include fixed media (e.g., RAM, ROM, a fixed hard drive, etc.) as well as removable media (e.g., a flash memory drive, a removable hard drive, optical disks, magnetic disks, and so forth). One or more input/output (I/O) device(s) 2512 may also communicate via a user interface (UI) controller 2514, which may connect with I/O device(s) 2512 either directly or through bus 2508.

In one possible implementation, a network interface 2516 may communicate outside of device 2500 via a connected network. A media drive/interface 2518 can accept removable tangible media 2520, such as flash drives, optical disks, removable hard drives, software products, etc. In one possible implementation, logic, computing instructions, and/or software programs comprising elements of module 2506 may reside on removable media 2520 readable by media drive/interface 2518.

In one possible embodiment, input/output device(s) 2512 can allow a user (such as a human annotator) to enter commands and information to device 2500, and also allow information to be presented to the user and/or other components or devices. Examples of input device(s) 2512 include, for example, sensors, a keyboard, a cursor control device (e.g., a mouse), a microphone, a scanner, and any other input devices known in the art. Examples of output devices include a display device (e.g., a monitor or projector), speakers, a printer, a network card, and so on.

Various systems and processes of present disclosure may be described herein in the general context of software or program modules, or the techniques and modules may be implemented in pure computing hardware. Software generally includes routines, programs, objects, components, data structures, and so forth that perform particular tasks or implement particular abstract data types. An implementation of these modules and techniques may be stored on or transmitted across some form of tangible computer-readable media. Computer-readable media can be any available data storage medium or media that is tangible and can be accessed by a computing device. Computer readable media may thus comprise computer storage media. "Computer storage media" designates tangible media, and includes volatile and non-volatile, removable, and non-removable tangible media implemented for storage of information such as computer readable instructions, data structures, program modules, or other data. Computer storage media include, but are not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other tangible medium which can be used to store the desired information, and which can be accessed by a computer.

Some of the methods and processes described above can be performed by a processor. The term "processor" should not be construed to limit the embodiments disclosed herein to any particular device type or system. The processor may include a computer system. The computer system may also include a computer processor (e.g., a microprocessor, microcontroller, digital signal processor, general-purpose computer, special-purpose machine, virtual machine, software container, or appliance) for executing any of the methods and processes described above.

The computer system may further include a memory such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), a PC card (e.g., PCMCIA card), or other memory device.

Some of the methods and processes described above can be implemented as computer program logic for use with the computer processor. The computer program logic may be embodied in various forms, including a source code form or a computer executable form. Source code may include a series of computer program instructions in a variety of programming languages (e.g., an object code, an assembly language, or a high-level language such as C, C++, or JAVA). Such computer instructions can be stored in a non-transitory computer readable medium (e.g., memory) and executed by the computer processor. The computer instructions may be distributed in any form as a removable storage medium with accompanying printed or electronic documentation (e.g., shrink wrapped software), preloaded with a computer system (e.g., on system ROM or fixed disk), or distributed from a server or electronic bulletin board over a communication system (e.g., the Internet or World Wide Web).

Alternatively or additionally, the processor may include discrete electronic components coupled to a printed circuit board, integrated circuitry (e.g., Application Specific Integrated Circuits (ASIC)), and/or programmable logic devices (e.g., a Field Programmable Gate Arrays (FPGA)). Any of the methods and processes described above can be implemented using such logic devices.

Although only a few example embodiments have been described in detail above, those skilled in the art will readily appreciate that many modifications are possible in the example embodiments without materially departing from this invention.

Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A method for detecting and monitoring at least one condition of a wellbore and/or drill bit during drilling, the method comprising:

drilling the wellbore with the drill bit, wherein the drill bit is instrumented with a temperature sensor configured to measure temperature associated with a cutting element of the drill bit over time during drilling;

using the temperature sensor to generate temperature data representing temperature of the cutting element of the drill bit over time during drilling; and processing the temperature data to determine rate of penetration (ROP) of the drill bit during drilling, wherein the ROP of the drill bit is estimated using a computational model of drill bit ROP as a function of measured temperature, wherein the computational model is derived by fitting a linear function that relates drill bit ROP to temperature data, and wherein the computational model is calibrated for a given combination of rock type and cutting element or bit type.

2. A method according to claim 1, wherein:

the temperature sensor comprises a thermocouple, a resistance temperature detector (RTD), thermistor, semiconductor-based temperature sensor, infrared temperature sensor, thermometer, bimetallic sensor, change-of-state sensor, silicon diode, or other type of temperature sensor.

3. A method according to claim 1, wherein:

the temperature sensor is configured to measure temperature representative of temperature at or near a cutting surface of the cutting element.

4. A method according to claim 1, wherein:

the processing of the temperature data is performed by a downhole system or a surface-located system.

5. A drilling system comprising:

a drill bit for drilling wellbore through a formation, wherein the drill bit is instrumented with a temperature sensor configured to measure temperature associated with a cutting element of the drill bit over time during drilling;

a processor configured to:

generate or obtain temperature data representing temperature of the cutting element of the drill bit over time during drilling as measured by the temperature sensor; and process the temperature data to determine rate of penetration (ROP) of the drill bit during drilling, wherein the ROP of the drill bit is estimated using a computational model of drill bit ROP as a function of measured temperature, wherein the computational model is derived by fitting a linear function that relates drill bit ROP to temperature data, and wherein the computational model is calibrated for a given combination of rock type and cutting element or bit type.

6. A drilling system according to claim 5, wherein:

the temperature sensor comprises a thermocouple, a resistance temperature detector (RTD), thermistor, semiconductor-based temperature sensor, infrared temperature sensor, thermometer, bimetallic sensor, change-of-state sensor, silicon diode, or other type of temperature sensor.

7. A drilling system according to claim 5, wherein:

the temperature sensor is configured to measure temperature representative of temperature at or near a cutting surface of the cutting element.

8. A drilling system according to claim 5, wherein:

the processor comprises a downhole processor or a surface-located processor.

9. A method for detecting and monitoring at least one condition of a wellbore during drilling, the method comprising:

drilling the wellbore with the drill bit, wherein the drill bit is instrumented with a temperature sensor configured to measure temperature associated with a cutting element of the drill bit over time during drilling;

using the temperature sensor to generate temperature data representing temperature of the cutting element of the drill bit over time during drilling; and processing the temperature data to detect one or more faults or openings or cracks in the wellbore by detecting fluctuations in the temperature data over time.

* * * * *